US010062496B2

(12) United States Patent
Yalamanchili et al.

(10) Patent No.: US 10,062,496 B2
(45) Date of Patent: Aug. 28, 2018

(54) PLANAR TRANSFORMER

(71) Applicant: Lear Corporation, Southfield, MI (US)

(72) Inventors: Venkat R. Yalamanchili, Farmington Hills, MI (US); Richard J. Hampo, Plymouth, MI (US)

(73) Assignee: Lear Corporation, Southfield, MI (US)

( * ) Notice: Subject to any disclaimer, the term of this patent is extended or adjusted under 35 U.S.C. 154(b) by 288 days.

(21) Appl. No.: 14/632,339

(22) Filed: Feb. 26, 2015

(65) Prior Publication Data

US 2016/0254087 A1 Sep. 1, 2016

(51) Int. Cl.
*H01F 27/28* (2006.01)
*H01F 27/30* (2006.01)
*H01F 27/32* (2006.01)

(52) U.S. Cl.
CPC ..... *H01F 27/2847* (2013.01); *H01F 27/303* (2013.01); *H01F 27/306* (2013.01); *H01F 27/323* (2013.01)

(58) Field of Classification Search
CPC ..... H01F 27/2819; H01F 27/2809; H01F 27/2804; H01F 27/2847; H01F 2027/2809; H01F 2027/2819; H01F 27/29
USPC ..... 336/200
See application file for complete search history.

(56) References Cited

U.S. PATENT DOCUMENTS 4,367,450 A * 1/1983 Carillo ..... H01F 17/0013 336/200
5,010,314 A 4/1991 Estrov
5,179,365 A 1/1993 Raggi
5,367,275 A * 11/1994 Esaki ..... H03H 1/0007 333/184
6,278,353 B1 * 8/2001 Downing ..... H01F 27/2804 336/200
6,320,490 B1 11/2001 Clayton
7,091,817 B2 8/2006 Peck et al.
7,289,329 B2 10/2007 Chen et al.
7,498,921 B1 3/2009 Wang
8,947,190 B2 2/2015 Park
9,401,243 B2 7/2016 Park
2002/0070836 A1 * 6/2002 Fujiyoshi ..... H01F 27/2852 336/200
2002/0130753 A1 * 9/2002 Merriam ..... H01F 17/0013 336/223

(Continued)

FOREIGN PATENT DOCUMENTS

CN 1357897 A 7/2002
CN 101645345 A 2/2010

(Continued)

OTHER PUBLICATIONS

JP 2002237419 A, machine translation, Aug. 2002.*

(Continued)

*Primary Examiner* — Elvin G Enad
*Assistant Examiner* — Malcolm Barnes
(74) *Attorney, Agent, or Firm* — Brooks Kushman P.C.

(57) ABSTRACT

A planar transformer includes conductor plates each having a channel separating a region of the conductor plate into first and second portions. Each conductor plate corresponds to one wire turn of a winding coil with one of the first and second portions being a start point of the wire turn and the other one of the first and second portions being an end point of the wire turn.

9 Claims, 4 Drawing Sheets

(56) References Cited

U.S. PATENT DOCUMENTS

| | | | | |
|---|---|---|---|---|
| 2003/0222751 | A1 | 12/2003 | Fujiyoshi et al. | |
| 2005/0212640 | A1 | 9/2005 | Chiang et al. | |
| 2006/0279394 | A1* | 12/2006 | Estrov | H01F 27/2804 336/200 |
| 2008/0290976 | A1 | 11/2008 | Feldtkeller | |
| 2012/0235780 | A1* | 9/2012 | Maple | H01F 27/2847 336/207 |
| 2013/0099885 | A1* | 4/2013 | Park | H01F 27/2847 336/170 |
| 2013/0207766 | A1* | 8/2013 | Kim | H01F 3/14 336/170 |
| 2013/0312930 | A1 | 11/2013 | Yalamanchili et al. | |
| 2015/0102883 | A1 | 4/2015 | Park | |
| 2015/0235756 | A1* | 8/2015 | Chen | H01F 27/2852 336/192 |
| 2016/0225515 | A1* | 8/2016 | Chen | H01F 27/2847 |

FOREIGN PATENT DOCUMENTS

| | | | | | |
|---|---|---|---|---|---|
| CN | 103081044 | A | | 5/2013 | |
| CN | 203850116 | U | * | 9/2014 | H01F 27/29 |
| CN | 203850116 | U | * | 9/2014 | H01F 27/28 |
| EP | 1973124 | B1 | | 4/2012 | |
| JP | 2002237419 | A | * | 8/2002 | H01F 27/28 |
| JP | 2002237419 | A | * | 8/2002 | H01F 27/16 |
| WO | 9115861 | A1 | | 10/1991 | |
| WO | 0116970 | A1 | | 3/2001 | |
| WO | 2011162473 | A2 | | 12/2011 | |

OTHER PUBLICATIONS

CN 203850116 U, machine translation, Sep. 2014.*
JP2002237419A, Machine Translation, Aug. 2002.*
CN203850116U, Machine Translation, Sep. 2014.*
Intellectual Property Office, Combined Search and Examination Report for corresponding GB Patent Application No. GB1518054.0 dated Dec. 4, 2015.
The State Intellectual Property Office of People's Republic of China, Translation of The Second Office Action for the counterpart Chinese Patent Application No. 201610084485.6 dated Jan. 3, 2018.
The State Intellectual Property Office of People's Republic of China, First Office Action for the corresponding Chinese Patent Application No. 201610084485.6 dated Jul. 4, 2017 and Machine English translation.

* cited by examiner

#1
#2
#3
#4
#5
#6
#7
#8
#9
28
30
32
38
40
40a
40b
42
42a
42b
44
46
48a
48c
50
52
54
56
58
60
62
64
66
68
70
72
73
74
76
78
82
84
86
88
90
92
A
A'
B
B'
C'
D'

PLANAR TRANSFORMER

TECHNICAL FIELD

The present invention relates to planar electrical transformers.

BACKGROUND

Electrical transformers typically include a primary winding and a secondary winding wound about a magnetic core. Energy from the primary winding transfers to the secondary winding through electromagnetic induction using the magnetic core.

In a conventional transformer, the primary winding is an electrically conductive wire such as a copper wire. A portion of the wire is in the form of a winding coil wound about the magnetic core with an amount of winding turns. Each winding turn of the winding coil is one loop of the wire. Similarly, the secondary winding is another wire and a portion of this wire is in the form of a winding coil wound about the magnetic core with an amount of winding turns.

In a planar transformer, the winding coils are flat, or planar, electrically conductive elements instead of wire loops. For instance, winding coils in certain planar transformers are spiral copper traces on a planar surface. In this type of planar transformer, a winding coil of the primary winding is a spiral of traces on a first board and a winding coil of the secondary winding is a spiral of traces on a second board.

SUMMARY

A planar transformer includes conductor plates each having a channel separating a region of the conductor plate into first and second portions. Each conductor plate corresponds to one wire turn of a first winding coil with one of the first and second portions being a start point of the wire turn and the other one of the first and second portions being an end point of the wire turn.

The transformer further includes insulator sheets. The conductor plates are stacked on top of one another with an insulator sheet between each pair of conductor plates and the conductor plates are connected together at connection areas of the first and second portions of the conductor plates to establish electrical continuity from one conductor plate to the next conductor plate and thereby form a first packet corresponding to the first winding coil.

The end point of a first one of the conductor plates is connected to the start point of a second one of the conductor plates and the end point of the second one of the conductor plates is connected to the start point of a third one of the conductor plates.

The insulator sheets include windows aligned with the connection areas of the conductor plates, wherein the conductor plates are connected together at the connection areas through the windows of the insulator sheets and the insulator sheets otherwise prevent the conductor plates from being connected together such that the conductor plates are not inadvertently shorted together.

The conductor plates may include a terminal conductor plate having a terminal tab extending from the first portion of the terminal conductor plate, and the second portion of the terminal conductor plate includes first and second connection areas for the terminal conductor plate to be connected at one of the first and second connection areas to another one of the conductor plates.

The conductor plates may further include a tab conductor plate having a bending tab extending from the second portion of the tab conductor plate, and the first portion of the tab conductor plate includes a connection area for the tab conductor plate to be connected at the connection area to another one of the conductor plates.

The conductor plates may further include at least one common conductor plate. The first portion of each common conductor plate includes a first connection area for the common conductor plate to be connected at the first connection area to another one of the conductor plates and the second portion of each common conductor plate includes a second connection area for the common conductor plate to be connected at the second connection area to some other one of the conductor plates.

The first and second common conductor plates have the same type of configuration and are flipped relative to one another such that the second portion of the first common conductor plate is the end point of the first common conductor plate and the second portion of the second common conductor plate is the start point of the second common conductor plate.

The conductor plates may be full planar copper stamped conductor plates.

The insulator sheets may be made of Nomex® insulation.

Another planar transformer includes packets each including conductor plates and insulator sheets. Each conductor plate has a channel separating a region of the conductor plate into first and second portions. The packets respectively correspond to winding coils and the conductor plates of each packet respectively corresponding to wire turns of the winding coil corresponding to the packet. In each packet the conductor plates of the packet are stacked on top of one another with an insulator sheet between each pair of the conductor plates of the packet and the conductor plates of the packet are connected together at connection areas of the first and second portions to establish electrical continuity between the conductor plates of the packet.

Conductor plates of a first set of the packets may be connected together to form a secondary winding and conductor plates of a second set of the packets exclusive of the conductor plates of the first set of packets may be connected together to form a primary winding.

The conductor plates of all of the packets may include only three types of conductor plates. The insulator sheets in any packet may include only three types of insulator sheets.

DETAILED DESCRIPTION

Detailed embodiments of the present invention are disclosed herein; however, it is to be understood that the disclosed embodiments are merely exemplary of the present invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
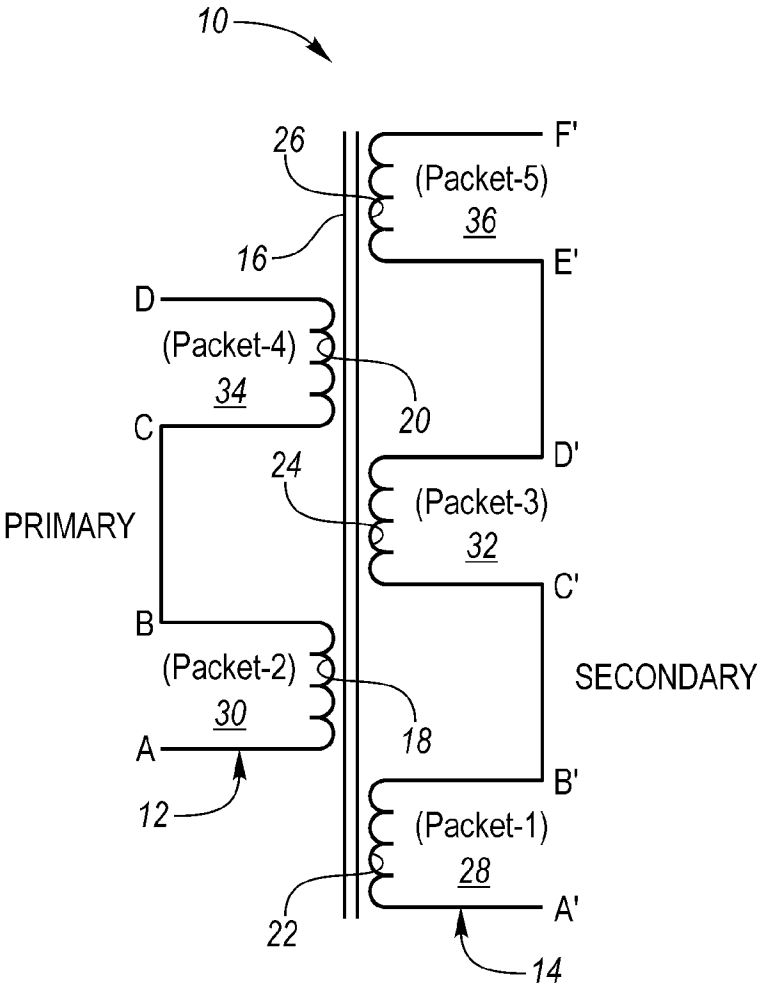
FIG. 1 illustrates an electrical schematic diagram of a planar transformer including a primary winding having two winding coils wound about a magnetic core and a secondary winding having three winding coils wound about the magnetic core.

Referring now to FIG. 1, an electrical schematic diagram of a planar transformer 10 is shown. Planar transformer 10 includes a primary winding 12, a secondary winding 14, and a magnetic core 16. Primary winding 12 includes a first primary winding coil 18 and a second primary winding coil 20. Primary winding coils 18 and 20 include respective pluralities of winding turns wound around magnetic core 16. The winding turns of primary winding coils 18 and 20 are wound in the same direction around magnetic core 16. Secondary winding 14 includes a first secondary winding coil 22, a second secondary winding coil 24, and a third secondary winding coil 26. Secondary winding coils 22, 24, and 26 include respective pluralities of winding turns wound around magnetic core 16. The winding turns of secondary winding coils 22, 24, and 26 are wound in the same direction around magnetic core 16.

As indicated in FIG. 1, primary winding coils 18 and 20 and secondary winding coils 22, 24, and 26 are wound around magnetic core 16 at corresponding locations along the length of the magnetic core. Further, the primary and secondary winding coils are interleaved longitudinally along magnetic core 16. First primary winding coil 18 is between first and second secondary winding coils 22 and 24 along the length of magnetic core 16; second secondary winding coil 24 is between first and second primary winding coils 18 and 20 along the length of magnetic core 16; and second primary winding coil 20 is between second and third secondary winding coils 24 and 26 along the length of magnetic core 16.

Each winding coil 18, 20, 22, 24, and 26 includes a pair of taps. Each tap of a winding coil is a start point or end point of the winding coil. First primary winding coil 18 includes taps A and B; and second primary winding coil 20 includes taps C and D. Tap B of first primary winding coil 18 and tap C of second primary winding coil 20 are connected together to thereby electrically connect primary winding coils 18 and 20 and form primary winding 12. Tap A of first primary winding coil 18 represents the start tap of primary winding 12. Tap D of second primary winding coil 20 represents the end tap of primary winding 12.

Similarly, first secondary winding coil 22 includes taps A' and B'; second secondary winding coil 24 includes taps C' and D'; and third secondary winding coil 26 includes taps E' and F'. Tap B' of first secondary winding coil 22 and tap C' of second secondary winding coil 24 are connected together to thereby electrically connect secondary winding coils 22 and 24. Tap D' of second secondary winding coil 24 and tap E' of third secondary winding coil 26 are connected together to thereby electrically connect secondary winding coils 24 and 26. Secondary winding coils 22, 24, and 26 electrically connected together form secondary winding 14. Tap A' of first secondary winding coil 22 represents the start tap of secondary winding 14. Tap F' of first secondary winding coil 22 represents the end tap of secondary winding 14.

Winding coils 18, 20, 22, 24, and 26 are flat, or planar, so that planar transformer 10 is a "planar" transformer. The winding coils are formed by respective packets of planar components.

As indicated in FIG. 1, a first packet 28 (PACKET-1) forms first secondary winding coil 22, a second packet 30 (PACKET-2) forms first primary winding coil 18, a third packet 32 (PACKET-3) forms second secondary winding coil 24, a fourth packet 34 (PACKET-4) forms second primary winding coil 20, and a fifth packet 36 (PACKET-5) forms third secondary winding coil 26.

Referring now to FIGS. 2A, 2B, 2C, 2D, and 2E, with continual reference to FIG. 1, packets 28, 30, 32, 34, and 36 which respectively form winding coils 18, 20, 22, 24, and 26 will be described. The packets include one or more conductor plates. The conductor plates have a planar shape and are of an electrically conductive material such as copper. The conductor plates have a top surface and a bottom surface. At least a portion of one of the surfaces includes the electrically conductive material. In an embodiment, the conductor plates are copper plates. In an embodiment, the conductor plates are full planar copper stamped conductor plates formed entirely of copper.

A conductor plate is one winding turn of a winding coil. Thus, a packet having three conductor plates forms a winding coil having three winding turns; a packet having seven conductor plates forms a winding coil having seven winding turns; etc. The conductor plates in a packet are physically connected (e.g., soldered) together at designated connection areas to establish electrical continuity from one conductor plate to the next. Accordingly, a first winding turn formed by a first conductor plate is electrically connected to a second winding turn formed by a second conductor plate at the location where the first winding turn transitions into the second winding turn.

Packets 28, 30, 32, 34, and 36 further include insulator sheets. In the packets, pairs of insulator sheets sandwich corresponding ones of the conductor plates. The insulator sheets insulate the conductor plates from one another except at the designated connection areas of the conductor plates. The insulator sheets do not prevent the conductor plates from being electrically connected together at the designated connection areas, but otherwise prevent the conductor plates from being electrically connected together such that the conductor plates are not inadvertently shorted together. This is analogous to wire loops of an insulated-covered winding coil being contiguously connected without being inadvertently shorted together. The insulator sheets have a planar shape corresponding to the planar area of the conductor plates. In an embodiment, the insulator sheets are made of Nomex® insulation. The conductor plates may alternatively be insulated from one another via an insulating coating, such as a varnish, applied to the conductor plates.

Figures 2A, 2B, 2C:
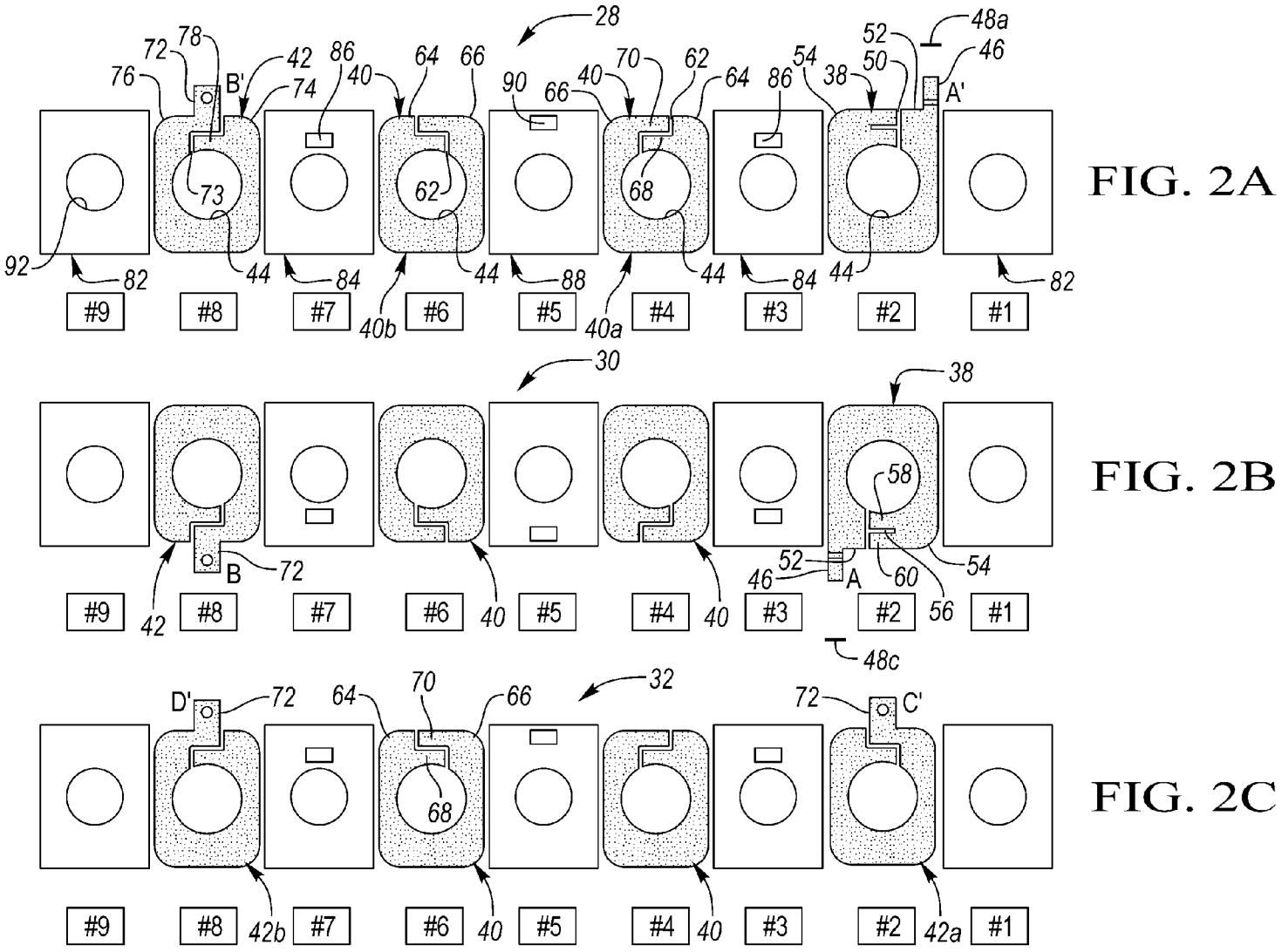
FIG. 2A illustrates an exploded view of conductor plates and insulator sheets of a first packet forming a first winding coil of the secondary winding.
FIG. 2B illustrates an exploded view of conductor plates and insulator sheets of a second packet forming a first winding coil of the primary winding.
FIG. 2C illustrates an exploded view of conductor plates and insulator sheets of a third packet forming a second winding coil of the secondary winding.

FIG. 2A illustrates an exploded view of first packet 28 which forms first secondary winding coil 22. First packet 28 includes four conductor plates: a terminal conductor plate 38, two common conductor plates 40, and a tab conductor plate 42. First packet 28 further includes a plurality of insulator sheets. The conductor plates and the insulator sheets are to be stacked on top of one another in the order of the layout shown in FIG. 2A to form the assembled first packet 28 (shown in FIG. 3).

First secondary winding coil 22 has four winding turns as first packet 28 includes four conductor plates. Conductor plates 38, 40, and 42 are full planar copper stamped conductor plates having the same planar profile and rectangular perimeter configuration. Conductor plates 38, 40, and 42 include a circular-shaped hole 44 in a central region of the rectangular area of the conductor plates.

Terminal conductor plate 38 includes a terminal tab 46. With reference to FIG. 1, terminal tab 46 corresponds to tap A' of first secondary winding coil 22. Tap A' is a start point of first secondary winding coil 22. Terminal tab 46 extends out past the rectangular perimeter of terminal conductor plate 38 and is associated with a terminal 48*a*. Terminal 48*a* is to be physically connected to terminal tab 46. For instance, terminal tab 46 is physically connected to a slit of terminal 48*a*.

Terminal conductor plate 38 includes a radial channel 50. Radial channel 50 runs radially between the perimeter and hole 44 of terminal conductor plate 38. Radial channel 50 functions to interrupt electrical continuity between a first portion 52 and a second portion 54 of terminal conductor plate 38 adjacent the radial channel. First portion 52 is adjacent terminal tab 46, which is the start point of first secondary winding coil 22. As such, first portion 52 corresponds to a start point of a wire turn and second portion 54 corresponds to an end point of the wire turn.

Terminal conductor plate 38 further includes an axial channel 56 (labeled in FIG. 2B). Axial channel 56 runs axially from radial channel 50 into the region of second portion 54 of terminal conductor plate 38. Axial channel 56 functions to physically form a first connection area 58 and a second connection area 60 in second portion 54 (labeled in FIG. 2B). Connection areas 58 and 60 are opposite one another on respective sides of axial channel 56. First connection area 58 provides an area of second portion 54 (i.e., the end point) of terminal conductor plate 38 for being soldered to another conductor plate. In this way, terminal conductor plate 38 and the other conductor plate can be electrically connected together at second portion 54 (the end point) of the terminal conductor plate. Likewise, second connection area 60 provides an area of terminal conductor plate 38 for being soldered to another conductor plate. In this way, terminal conductor plate 38 and the other conductor plate can be electrically connected together in an alternate manner at second portion 54 (the end point) of the terminal conductor plate.

Common conductor plate 40 includes a serpentine channel 62. Serpentine channel 62 runs in a serpentine pattern between the perimeter and hole 44 of common conductor plate 40. Serpentine channel 62 functions to interrupt electrical continuity between a first portion 64 and a second portion 66 of common conductor plate 40 adjacent serpentine channel 62. First portion 64 of common conductor plate 40 corresponds to one of a start or end point of a wire turn. Second portion 66 of common conductor plate 40 corresponds to the other one of a start or end point of a wire turn.

Serpentine channel 62 further functions to physically form a first connection area 68 in first portion 64 of common conductor plate 40 and a second connection area 70 in second portion 66 of the common conductor plate. Connection areas 68 and 70 are opposite one another on respective sides of an axial running portion of serpentine channel 62. First connection area 68 provides an area of first portion 64 (e.g., the start point) of common conductor plate 40 for being soldered to another conductor plate. In this way, common conductor plate 40 and the other conductor plate can be electrically connected together at first portion 64 (e.g., the start point) of the common conductor plate. Likewise, second connection area 70 provides an area of second portion 66 (e.g., the end point) of common conductor plate 40 for being soldered to another conductor plate. In this way, common conductor plate 40 and the other conductor plate can be electrically connected together at second portion 66 (e.g., the end point) of the common conductor plate.

The two common conductor plates 40 of first packet 28, along with common conductor plates 40 of packets 30, 32, 34, and 36 respectively shown in FIGS. 2B, 2C, 2D, and 2E, are the same type of conductor plate. That is, one type of common conductor plate having serpentine pattern 62 and the other described features is used for the common conductor plates in the packets. In the packets, common conductor plates 40 are flipped over with respect to one another from one common conductor plate to the next common conductor plate as shown in FIGS. 2A, 2B, 2C, and 2D and best shown in FIG. 2D. As such, neighboring common conductor plates 40 are in a "mirrored" configuration with respect to one another as the common conductor plates are of the same type.

As a result, the connection area of the end point of a first common conductor plate aligns with the connection area of the start point of a second common conductor plate; the connection area of the end point of the second common conductor plate aligns with the connection area of the start point of a third common conductor plate; etc.

For instance, in first packet 28 shown in FIG. 2A, the two common conductor plates 40, further designated with respective reference numerals 40*a* and 40*b*, are flipped relative to one another. Second portion 66 of first common conductor plate 40*a* is an end point of first common conductor plate 40*a* whereas second portion 66 of second common conductor plate 40*b* is a start point of second common conductor plate 40*b*. Common conductor plates 40*a* and 40*b* are to be electrically connected together at connection area 70 of second portion 66 of first common conductor plate 40*a* (i.e., the end point of first common conductor plate 40*a*) and connection area 70 of second portion 66 of second common conductor plate 40*b* (i.e., the start point of second common conductor plate 40*b*). As a result of the "mirrored" configuration, connection area 70 of second portion 66 (the end point) of first common conductor plate 40*a* and connection area 70 of second portion 66 (the start point) of second common conductor plate 40*b* are aligned with one another to enable the two connection areas 70 to be soldered together and thereby electrically connect the end point of first common conductor plate 40*a* to the start point of second common conductor plate 40*b*. In this way, two wire turns corresponding to common conductor plates 40*a* and 40*b* are electrically connected.

Further, first common conductor plate 40*a* and terminal conductor plate 38 are to be electrically connected together. First portion 64 of first common conductor plate 40*a* is a start point of first common conductor plate 40*a* and second portion 54 of terminal conductor plate 38 is an end point of the terminal conductor plate. Conductor plates 40*a* and 38 are to be electrically connected together at connection area 68 of first portion 64 of first common conductor plate 40*a* (i.e., the start point of first common conductor plate 40*a*) and second portion 54 of terminal conductor plate 38 (i.e., the end point of terminal conductor plate 38). Connection area 68 of first common conductor plate 40*a* and connection area 58 of terminal conductor plate 38 are aligned with one another. Accordingly, connection area 68 of first common conductor plate 40*a* and connection area 58 of terminal conductor plate 38 can be soldered together to thereby electrically connect the start point of first common conductor plate 40*a* and the end point of terminal conductor plate 38.

The significance of second portion 54 of terminal conductor plate 38 having two separate connection areas 58 and 60 in second portion 54 of the terminal conductor plate will now be described in greater detail. As described above, connection area 68 of first portion 64 (i.e., the start point) of first common conductor plate 40*a* and connection area 58 of second portion 54 (i.e., the end point) of terminal conductor plate 38 are aligned with one another for being soldered together. However, if first common conductor plate 40*a* was flipped over to have the arrangement of second common conductor plate 40*b*, then second portion 66 would be the start point of first common conductor plate 40*a*. As such, connection area 70 of second portion 66 (i.e., the start point) of first common conductor plate 40*a* is to be electrically connected to second portion 54 (i.e., the end point) of terminal conductor plate 38. Terminal conductor plate 38 having two separate connection areas 58 and 60 in second portion 54 enables this electrical connection as connection area 70 of second portion 66 of first common conductor plate 40*a* and connection area 60 (instead of connection area 58) of second portion 54 of terminal conductor plate 38 are aligned with one another.

Tab conductor plate 42 includes a (bending) tab 72. With reference to FIG. 1, tab 72 corresponds to tap B' of first secondary winding coil 22. Tap B' is an end point of first secondary winding coil 22. Tab 72 extends out past the rectangular perimeter of tab conductor plate 42.

Tab conductor plate 42 includes a serpentine channel 73. Serpentine channel 73 runs in a serpentine pattern between the perimeter and hole 44 of tab conductor plate 42. Serpentine channel 73 functions to interrupt electrical continuity between a first portion 74 and a second portion 76 of tab conductor plate 42 adjacent serpentine channel 73. Second portion 76 of tab conductor plate 42 is adjacent tab 73, which is the end point of first secondary winding coil 18. As such, first portion 74 of tab conductor plate 42 corresponds to a start point of a wire turn and second portion 76 corresponds to an end point of the wire turn. Serpentine channel 73 further functions to physically form a connection area 78 in first portion 74 of tab conductor plate 42 which is to serve as a designated connection areas for being soldered to another conductor plate.

Tab conductor plate 42 and a common conductor plate 40 are to be electrically connected together. In particular, in first packet 28, the start point of tab conductor plate 42 and the end point of second common conductor plate 40*b* are to be soldered together. Connection area 78 provides an area of first portion 74 (i.e., the start point) of tab conductor plate 42 for being soldered to the end point of second common conductor plate 40*b*. The end point of second common conductor plate 40*b* is first portion 64 of second common conductor plate 40*a*. Connection area 78 of first portion 74 of tab conductor plate 42 and connection area 68 of first portion 64 of second conductor plate 40*b* are aligned with one another. Accordingly, connection area 78 of tab conductor plate 42 and connection area 68 of second common conductor plate 40*b* can be soldered together to thereby electrically connect the start point of tab conductor plate 42 and the end point of second common conductor plate 40*b*.

As indicated above, packets 28, 30, 32, 34, and 36 further include insulator sheets. In the packets, pairs of stacked insulator sheets sandwich corresponding ones of the stacked conductor plates. The insulator sheets insulate the conductor plates from one another except at the designated connection areas of the conductor plates. The insulator sheets do not prevent the conductor plates from being electrically connected together at the designated connection areas, but otherwise prevent the conductor plates from being electrically connected together such that the conductor plates are not inadvertently shorted together.

As shown in FIG. 2A, first packet 28 includes five insulator sheets: two end insulator sheets 82; two insulator sheets 84 having a radially-in positioned window 86; and an insulator sheet 88 having a radially-out positioned window 90. Insulator sheets 82, 84, and 88 have the same planar profile and rectangular perimeter configuration. Insulator sheets 82, 84, and 88 include a circular-shaped hole 92 in a central region of the rectangular area of the insulator sheets. Circular-shaped hole 92 has a smaller circumference than circular-shaped hole 44 of the conductor plates. Circular-shaped holes 44 and 92 are aligned in the stacked conductor plates and insulator sheets of the assembled packets.

In first packet 28, a first insulator sheet 84 having a radially-in positioned window 86 is positioned between terminal conductor plate 38 and first common conductor plate 40*a*. Window 86 aligns with connection area 58 of first portion 56 (the end point) of terminal conductor plate 38 and connection area 68 of first portion 64 (the start point) of first common conductor plate 40*a*. Otherwise, first insulator sheet 84 insulates terminal conductor plate 38 and first common conductor plate 40*a* from one another. As such, the end point of terminal conductor plate 38 and the start point of first common conductor plate 40*a* can be soldered together while the remaining entirety of terminal conductor plate 38 and first common conductor plate 40*a* are insulated from one another to thereby prevent any inadvertent shorting thereof.

Similarly, a second insulator sheet 84 having a radially-in positioned window 86 is positioned between tab conductor plate 42 and second common conductor plate 40*b*. Window 86 aligns with connection area 78 (the start point) of tab conductor plate 42 and connection area 68 of first portion 64 (the end point) of second common conductor plate 40*b*. Otherwise, second insulator sheet 84 insulates tab conductor plate 42 and second common conductor plate 40*b* from one another. As such, the start point of tab conductor plate 42 and the end point of second common conductor plate 40*b* can be soldered together while the remaining entirety of tab conductor plate 42 and second common conductor plate 40*b* are insulated from one another to thereby prevent any inadvertent shorting thereof.

Further in packet 28 an insulator sheet 88 having a radially-out positioned window 90 is positioned between common conductor plates 40*a* and 40*b*. Window 90 aligns with connection area 70 of second portion 66 (the end point) of first common conductor plate 40*a* and connection area 70 of second portion 66 (the start point) of second common conductor plate 40*b*. Otherwise, insulator sheet 88 insulates common conductor plates 40*a* and 40*b* from one another. As such, the end point of first common conductor plate 40*a* and the start point of second common conductor plate 40*b* can be soldered together while the remaining entirety of the common conductor plates are insulated from one another to thereby prevent any inadvertent shorting thereof.

With continual reference to FIGS. 1 and 2A, FIGS. 2B, 2C, 2D, and 2E illustrate exploded views of conductor plates and insulator sheets of second, third, fourth, and fifth packets 30, 32, 34, and 36, respectively. Second and fourth packets 30 and 34 respectively form primary winding coils 18 and 20 of primary winding 12. First, third, and fifth packets 28, 32, and 36 respectively form secondary winding coils 22, 24, and 26 of secondary winding 14. The configuration of conductor plates and insulator sheets of packets 30, 32, 34, and 36 follow the description of the conductor plates and insulator sheets of first packet 28.

Figure 2D:
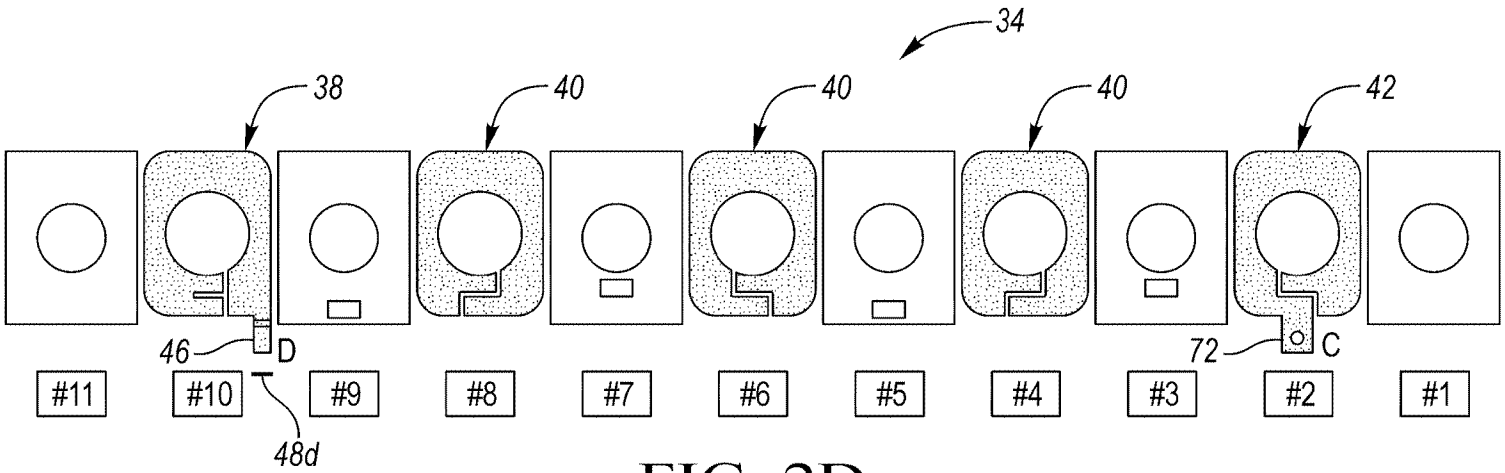
FIG. 2D illustrates an exploded view of conductor plates and insulator sheets of a fourth packet forming a second winding coil of the primary winding.
Figure 2E:
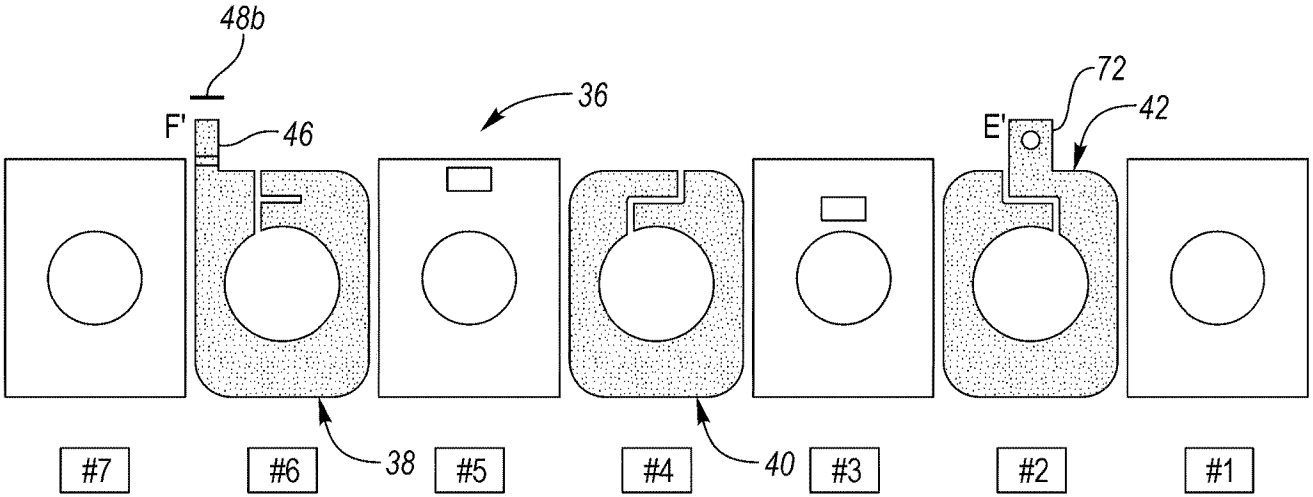
FIG. 2E illustrates an exploded view of conductor plates and insulator sheets of a fifth packet forming a third winding coil of the secondary winding.

Turning initially to secondary winding 14, as described, first packet 28 includes two common conductor plates 40 between a terminal conductor plate 38 and a tab conductor plate 42 in which terminal tab 46 of the terminal conductor plate corresponds to tap A' of first secondary winding coil 22 and tab 72 of the tab conductor plate corresponds to tap B' of first secondary winding coil 22 (FIG. 2A). The conductor plates and the insulator sheets of first packet 28 are stacked on top of one another in the order of the layout shown in FIG. 2A to form the assembled first packet 28 (shown in FIG. 3). Third packet 32 includes two common conductor plates 40 between first and second tab conductor plates 42*a* and 42*b* in which tab 72 of first tab conductor plate 42*a* corresponds to tap C' of second secondary winding coil 24 and tab 72 of second tab conductor plate 42*b* corresponds to tap D' of second secondary winding coil 24 (FIG. 2C). The conductor plates and the insulator sheets of third packet 32 are stacked on top of one another in the order of the layout shown in FIG. 2C to form the assembled third packet 32 (shown in FIG. 3). Third packet 32 includes one common conductor plate 40 between a tab conductor plate 42 and a terminal conductor plate 38 in which tab 72 of the tab conductor plate corresponds to tap E' of third secondary winding coil 26 and terminal tab 46 of the terminal conductor plate corresponds to tap F' of third secondary winding coil 26 (FIG. 2E). The conductor plates and the insulator sheets of fifth packet 36 are stacked on top of one another in the order of the layout shown in FIG. 2E to form the assembled third packet 36 (shown in FIG. 3).

As noted, terminal tab 46 of terminal conductor plate 38 of fifth packet 36 corresponds to tap F' of third secondary winding coil 26. Tap F' is an end point of third secondary winding coil 26, which is the end tap of secondary winding 14. Terminal tab 46 of terminal conductor plate 38 of third packet 36 is associated with a second terminal 48*b*. Second terminal 48*b* is to be physically connected to terminal tab 46 of terminal conductor plate 38 of third packet 36.

First secondary winding coil 22 formed by first packet 28 and second secondary winding coil 24 formed by second packet 32 are to be electrically connected together and second secondary winding coil 24 formed by the second packet and third secondary winding coil 26 formed by third packet 32 are to be electrically connected together to form secondary winding 14. In particular, tap B' of first packet 28 and tap C' of third packet 32 and tap D' of third packet 32 and tap E' of fifth packet 36 are to be electrically connected together to form secondary winding 14. In the assembled planar transformer 10, tab 72 (tap B') of first packet 28 and tab 72 (tap C') of third packet 32 are pushed towards each other to meet together and are then soldered together to establish an electrical connection; and tab 72 (tap D') of third packet 32 and tab 72 (tap E') of fifth packet 36 are pushed towards each other to meet together and are then soldered together to establish an electrical connection. As a result, packets 28, 32, and 36 respectively forming secondary winding coils 22, 24, and 26 are connected to thereby form secondary winding 14.

A load (not shown) is connected to secondary winding 14 by connecting to terminal 48*a* connected to terminal tab 46 (tap A') of terminal conductor plate 38 of first packet 28 and by connecting to second terminal 48*b* connected to terminal tab 46 (tap E') of terminal conductor plate 38 of fifth packet 36.

Turning now to primary winding 12, second packet 30 includes two common conductor plates 40 between a terminal conductor plate 38 and a tab conductor plate 42 in which terminal tab 46 of the terminal conductor plate corresponds to tap A of first primary winding coil 18 and tab 72 of the tab conductor plate corresponds to tap B of first primary winding coil 18 (FIG. 2B). The conductor plates and the insulator sheets of second packet 30 are stacked on top of one another in the order of the layout shown in FIG. 2B to form the assembled second packet 30 (shown in FIG. 3). Fourth packet 34 includes three common conductor plates 40 between a tab conductor plate 42 and a terminal conductor plate 38 in which tab 72 of the tab conductor plate corresponds to tap C of second primary winding coil 20 and terminal tab 46 of the terminal conductor plate corresponds to tap D of second primary winding coil 20 (FIG. 2D). The conductor plates and the insulator sheets of fourth packet 34 are stacked on top of one another in the order of the layout shown in FIG. 2D to form the assembled fourth packet 34 (shown in FIG. 3).

As noted, terminal tab 46 of terminal conductor plate 38 of second packet 30 corresponds to tap A of first primary winding coil 18, which is the start point of primary winding 12. Terminal tab 46 of terminal conductor plate 38 of second packet 30 is associated with a third terminal 48*c*. Third terminal 48*c* is to be physically connected to terminal tab 46 of terminal conductor plate 38 of second packet 30. Terminal tab 46 of terminal conductor plate 38 of fourth packet 34 corresponds to tap D of second primary winding coil 20, which is the end tap of primary winding 12. Terminal tab 46 of terminal conductor plate 38 of second packet 34 is associated with a fourth terminal 48*d*. Fourth terminal 48*d* is to be physically connected to terminal tab 46 of terminal conductor plate 38 of fourth packet 34.

First primary winding coil 18 formed by second packet 30 and second primary winding coil 20 formed by fourth packet 34 are to be electrically connected together to form primary winding 12. In particular, tap B of second packet 30 and tap C of fourth packet 34 are to be electrically connected together to form primary winding 12. In the assembled planar transformer 10, tab 72 (tap B) of second packet 34 and tab 72 (tap C) of fourth packet 34 are pushed towards each other to meet together and are then soldered together to establish an electrical connection. As a result, packets 30 and 34 respectively forming primary winding coils 18 and 20 are connected to thereby form primary winding 12.

A source (not shown) is connected to primary winding 12 by connecting to third terminal 48*c* connected to terminal tab 46 (tap A) of terminal conductor plate 38 of second packet 30 and to fourth terminal 48*b* connected to terminal tab 46 (tap D) of terminal conductor plate 38 of fourth packet 34.

As indicated in FIGS. 2B and 2D in comparison with FIGS. 2A, 2C, and 2E, the conductor plates and insulator sheets of second and fourth packets 30 and 34 forming primary winding 12 are rotated 180° relative to the conductor plates and insulator sheets of first, third, and fifth packets 28, 32, and 36 forming secondary winding 14. In this way, terminal tabs 46 and tabs 72 of the primary winding packets extend out of the assembled planar transformer 10 in one direction whereas terminal tabs 46 and tabs 72 of the secondary winding packets extend out of the assembled planar transformer 10 in an opposite direction (see FIGS. 3 and 4). Accordingly, tabs 72 of the primary winding packets can be pushed together and soldered without interference from tabs 72 of the secondary winding packets and vice versa. Further, terminal tabs 46 of the primary winding packets can be accessed with corresponding terminals without interference from terminal tabs 46 of the secondary winding packets and vice versa.

Figure 3:
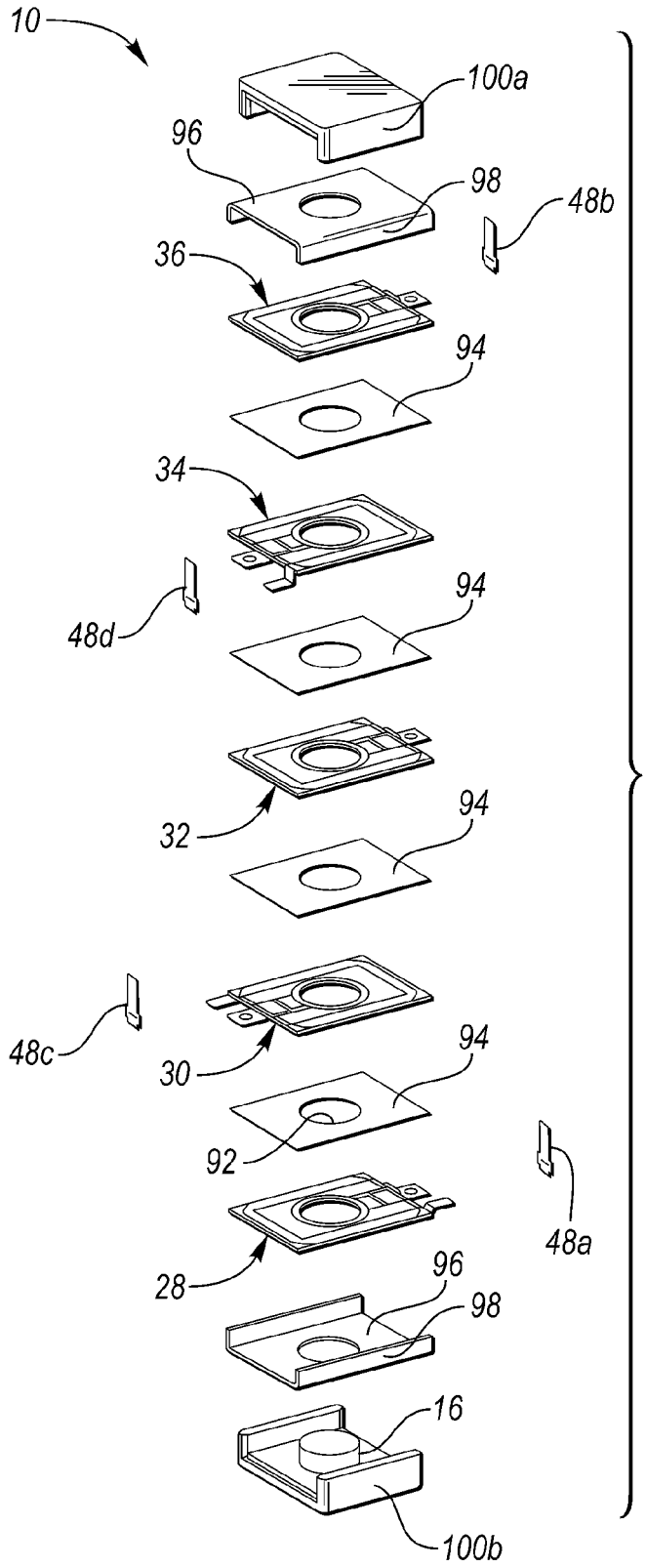
FIG. 3 illustrates an exploded view of the components of the planar transformer including the first, second, third, fourth, and fifth packets to be stacked on one another to form the assembled planar transformer.

FIG. 3 illustrates an exploded view of the components of planar transformer 10 including first, second, third, fourth, and fifth packets 28, 30, 32, 34, and 36 to be stacked on one another to form the assembled planar transformer. Other components of the assembled planar transformer 10 include intermediate insulator sheets 94, which are respectively positioned between the packets for additional insulation; top and bottom end insulator sheets 96, which sandwich the stacked packets and form outer wrap portions 98. Outer wrap portions 98 of the two end insulator sheets 96 meet one another in the assembled planar transformer to form an enclosure which holds the packets together therein. Thus, no designated carrier or bobbin for holding the packets together is employed in planar transformer. Insulator sheets 94 and 98 have the same planar profile and rectangular perimeter configuration and include circular-shaped hole 92 in a central region of the rectangular area. Insulator sheets 94 and 98 have a larger thickness than the thickness of the insulator sheets within the packets. The packets may include Kapton® tape thereon as shown in FIG. 3.

Planar transformer 10 further includes a pair of magnetic core members 100*a* and 100*b* placed around the stacked components. Magnetic core members 100*a* and 100*b* include a central arm having magnetic core 16 which extends through holes 44 and 92 in the central region of the rectangular area of the packets and insulator sheets. As shown in FIG. 3, magnetic core 16 has a circular circumference corresponding to the circular circumference of the holes 44 of the conductor plates of the packets.

Figure 4:
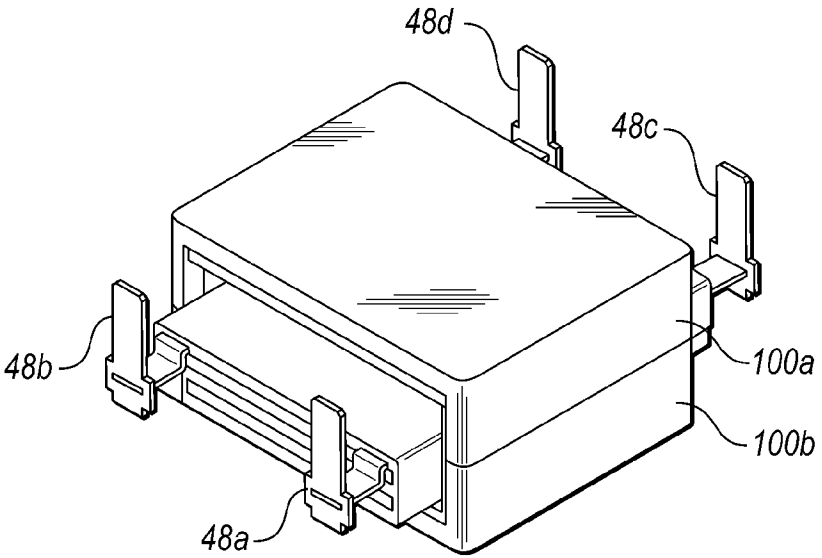
FIG. 4 illustrates a perspective view of the assembled planar transformer.

FIG. 4 illustrates a perspective view of the assembled planar transformer 10.

Planar transformer 10 as described herein is suitable for high-voltage (e.g., 7 kW) applications including high-voltage battery charger applications. The use of conductor plates corresponding to winding coil turns enables planar transformer 10 to be used in such high-voltage applications.

While exemplary embodiments are described above, it is not intended that these embodiments describe all possible forms of the present invention. Rather, the words used in the specification are words of description rather than limitation, and it is understood that various changes may be made without departing from the spirit and scope of the present invention. Additionally, the features of various implementing embodiments may be combined to form further embodiments of the present invention.

What is claimed is:

1. A planar transformer comprising:

a magnetic core;

a first packet having a first set of conductor plates forming a primary winding coil, the first packet being at a first position along the magnetic core;

a second packet having a second set of conductor plates forming a secondary winding coil, the second packet being at a second position along the magnetic core;

wherein the conductor plates of each packet are identical individual structures formed entirely of a conductive material detached from any insulator and have a same type of configuration including a same rectangular perimeter, each conductor plate having a serpentine channel separating a region of the conductor plate into a first portion having a first connection area within the rectangular perimeter and a second portion having a second connection area within the rectangular perimeter, each conductor plate further having a hole in a central region within the rectangular perimeter for receiving the magnetic core, each conductor plate corresponding to one wire turn of a winding coil with one of the first and second portions being a start point of the wire turn and the other one of the first and second portions being an end point of the wire turn;

wherein in each packet the conductor plates of the packet are stacked on top of one another with alternate ones of the conductor plates being flipped relative to one another such that the first connection areas of the conductor plates are aligned with the first connection areas of the flipped conductor plates and the second connection areas of the conductor plates are aligned with the second connection areas of the flipped conductor plates, the conductor plates are connected together within the rectangular perimeter at the connection areas of the conductor plates to establish electrical continuity between neighboring conductor plates to thereby form a corresponding one of the winding coils;

wherein the first packet further has a first set of insulator sheets and the second packet further has a second set of insulator sheets;

the insulator sheets of each packet have a single window and a hole for receiving the magnetic core and is either of a first type or a second type, wherein the single window of each insulator sheet of the first type is at a first position and the single window of each insulator sheet of the second type is at a second position; and in each packet the single window of each insulator sheet of the first type is aligned with the first connection areas of the conductor plates of the packet and the single window of each insulator sheet of the second type is aligned with the second connection areas of the conductor plates of the packet, and the insulator sheets of the first type are respectively between odd neighboring pairs of the conductor plates of the packet and the insulator sheets of the second type are respectively between even neighboring pairs of the conductor plates of the packet, the conductor plates of the packet being connected together at the connection areas of the conductor plates through the single windows of the insulator sheets.

2. The planar transformer of claim 1 wherein:

the first packet further has a first terminal conductor plate having the same rectangular perimeter and the second packet has a second terminal conductor plate having the same rectangular perimeter;

each terminal conductor plate has a channel separating a region of the terminal conductor plate into a first portion and a second portion, a hole in a central region within the rectangular perimeter for receiving the magnetic core, and a terminal tab extending from the first portion of the terminal conductor plate out past the rectangular perimeter, and the second portion of the terminal conductor plate includes a first connection area and a second connection area; and in each packet the terminal conductor plate of the packet is connected within the rectangular perimeter either at the first connection area of the terminal conductor plate to the first connection area of one of the conductor plates of the packet or at the second connection area to the second connection area of one of the conductor plates of the packet.

3. The planar transformer of claim 2 wherein:

the first packet further has a first tab conductor plate having the same rectangular perimeter and the second packet has a second tab conductor plate having the same rectangular perimeter;

each tab conductor plate has a channel separating a region of the tab conductor plate into a first portion having a first connection area within the rectangular perimeter and a second portion having a second connection area within the rectangular perimeter, a hole in a central region within the rectangular perimeter for receiving the magnetic core, and a bending tab extending from the second portion of the tab conductor plate out past the rectangular perimeter; and in each packet the tab conductor plate of the packet is connected within the rectangular perimeter at one of the first and second connection areas of the tab conductor plate to another one of the conductor plates of the packet.

4. The planar transformer of claim 1 wherein:

the conductor plates are full planar copper stamped conductor plates.

5. The planar transformer of claim 1 further comprising:

a third packet having a third set of conductor plates forming a second primary winding coil, the third packet being at a third position along the magnetic core;

wherein the conductor plates of the third packet are formed entirely of a conductive material detached from any insulator and have the same type of configuration including the same rectangular perimeter; and wherein in the third packet the conductor plates of the third packet are stacked on top of one another with alternate ones of the conductor plates being flipped relative to one another such that the first connection areas of the conductor plates are aligned with the first connection areas of the flipped conductor plates and the second connection areas of the conductor plates are aligned with the second connection areas of the flipped conductor plates, the conductor plates are connected together within the rectangular perimeter at the connection areas of the conductor plates to establish electrical continuity between neighboring conductor plates to thereby forming the second primary winding coil.

6. The planar transformer of claim 5 further comprising:

a fourth packet having a fourth set of conductor plates forming a second secondary winding coil, the fourth packet being at a fourth position along the magnetic core;

wherein the conductor plates of the fourth packet are formed entirely of a conductive material detached from any insulator and have the same type of configuration including the same rectangular perimeter; and wherein in the fourth packet the conductor plates of the fourth packet are stacked on top of one another with alternate ones of the conductor plates being flipped relative to one another such that the first connection areas of the conductor plates are aligned with the first connection areas of the flipped conductor plates and the second connection areas of the conductor plates are aligned with the second connection areas of the flipped conductor plates, the conductor plates are connected together within the rectangular perimeter at the connection areas of the conductor plates to establish electrical continuity between neighboring conductor plates to thereby forming the second secondary winding coil.

7. The planar transformer of claim 1 wherein:

the first and second packets have different amounts of the conductor plates.

8. The planar transformer of claim 5 wherein:

the first, second, and third packets have different amounts of the conductor plates.

9. The planar transformer of claim 6 wherein:

the first, second, third, and fourth packets have different amounts of the conductor plates.

* * * * *